United States Patent [19]

Maeshiba

[11] Patent Number: 4,572,254

[45] Date of Patent: Feb. 25, 1986

[54] LOCK SYSTEM PREVENTING MIXING OF DIFFERENT KINDS OF OIL AT GASOLINE STAND

[76] Inventor: Sozaburo Maeshiba, 1-33, 2-chome, Tani, Chuo-ku, Fukuoka, Japan

[21] Appl. No.: 588,210

[22] Filed: Mar. 12, 1984

[51] Int. Cl.[4] ..... E05B 65/00

[52] U.S. Cl. ..... 141/98; 70/265; 137/234.6

[58] Field of Search ..... 70/176, 265, DIG. 63; 137/234.6, 255, 383, 385; 141/311 R, 1, 98

[56] References Cited

U.S. PATENT DOCUMENTS

| | | | |
|---|---|---|---|
| 537,311 | 4/1895 | Schade | 70/265 |
| 1,042,107 | 10/1912 | Grant | 137/385 X |
| 1,339,083 | 5/1920 | Wood-Smith | 137/385 |

*Primary Examiner*—Stephen Marcus
*Assistant Examiner*—Mark Thronson
*Attorney, Agent, or Firm*—Brisebois & Kruger

[57] ABSTRACT

A lock system which prevents the mixing of different kinds of oil at a gasoline tank comprises: locks for different kinds of oils provided on each of couplings constituting oil filler ports of underground tanks of the gasoline stand and each of tank base valves of a tank truck, and keys separately provided for unlocking the locks for the different kinds of oil, wherein only the lock on the couplings of the oil filler ports which accepts a selected key which unlocks the corresponding tank base valve of the tank truck can be unlocked. When one of the tank base valves is opened and an oil filler hose is connected to the oil filler port of one of the underground tanks, only the oil filler port of the underground tank containing the same kind of oil as that in the corresponding tank of the tank truck can be opened, thereby ensuring that the same kind of oil is reliably poured into the underground tank from the tank truck. The keys are stored in a key-storing device which holds the keys separately for the different kinds of oil, and is constructed such that only one key for one kind of oil can be removed at a time. It is thereby possible to provide a lock system preventing the mixing of different kinds of oil at a gasoline stand, which can reliably prevent the mixing of different kinds of oil with simple devices and members.

2 Claims, 14 Drawing Figures

LOCK SYSTEM PREVENTING MIXING OF DIFFERENT KINDS OF OIL AT GASOLINE STAND

BRIEF SUMMARY OF THE INVENTION

Hitherto, there have been an uncountable number of accidents at gasoline stands in which a different kind of oil is poured into an underground tank from a tank truck. In order to prevent such an accidental mixing of different kinds of fuel or oil, a method is conventionally employed in which the same labels identifying the kind of oil are put on both the oil filler port of the underground tank and, for example, the valve opening the tank of the tank truck, and these are matched with each other to check what kind of oil is poured into the underground tank. However, this method, which relies on human visual acuity, is an extremely unreliable check, and therefore frequently results in the accidental mixing of different kinds of oils.

According to the present invention, therefore, a lock is provided on a tank base valve which must be operated when oil is poured into an underground tank from a tank truck, and the arrangement is such that a lock provided on a coupling of the oil filler port of the underground tank can be unlocked only with the key for the lock on the tank base valve, thereby insuring the same kind of oil is always poured into the underground tank from the tank truck.

DESCRIPTION OF THE PREFERRED EMBODIMENTS

Figure 1:
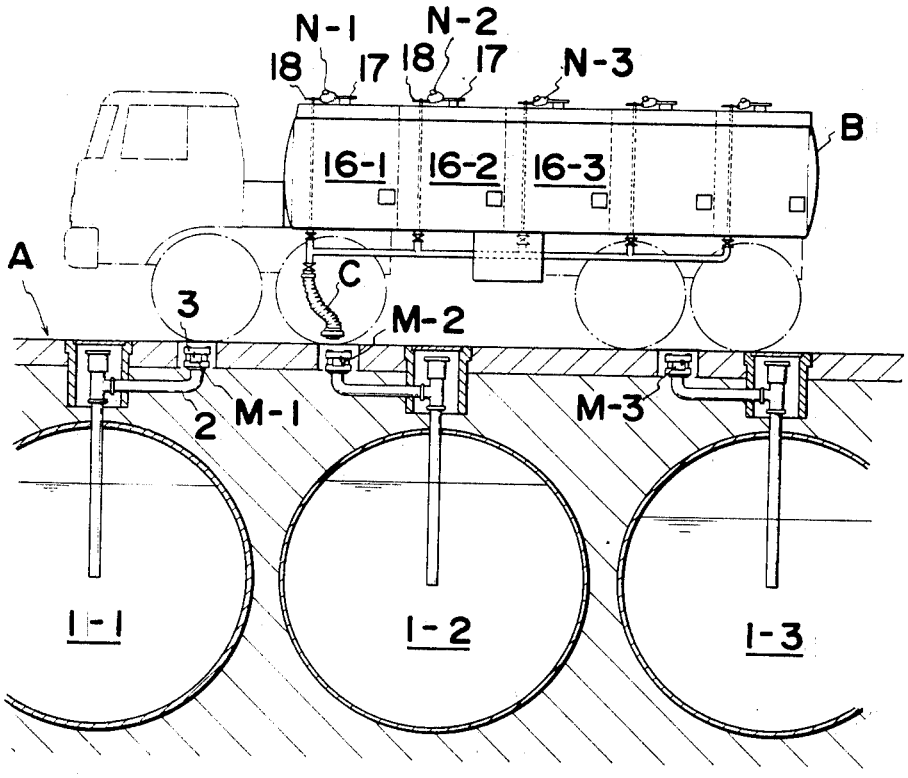
FIG. 1 illustrates the lock system in accordance with the present invention, in operation.
Figure 8:
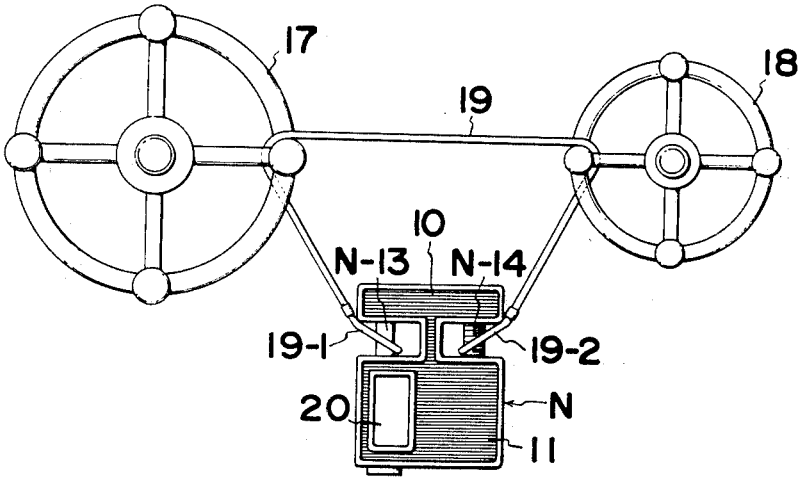
FIG. 8 illustrates the lock of FIG. 6 when used for a base valve handle and a hatch handle of a tank truck.
Figure 2:
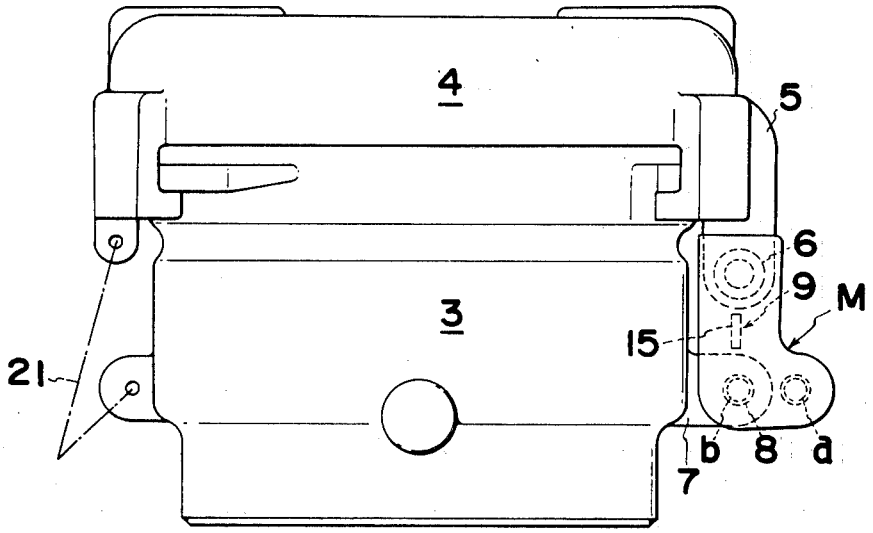
FIG. 2 is a side view of an essential part of the lock system of FIG 1.
Figure 3:
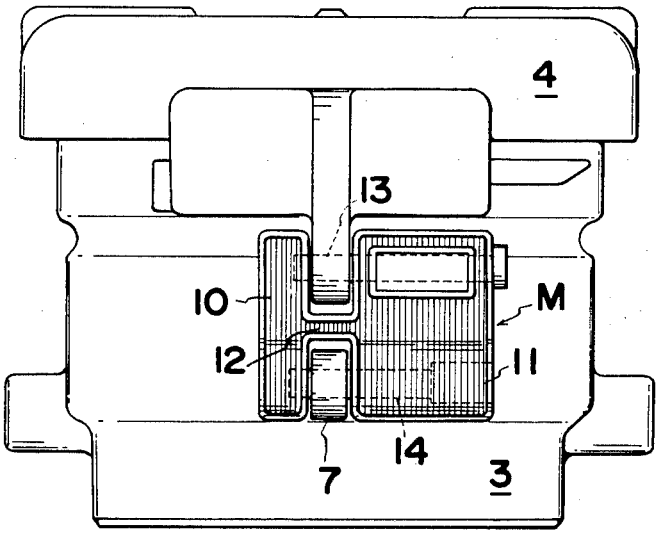
FIG. 3 is a front view of the essential part shown in FIG. 2.
Figure 4:
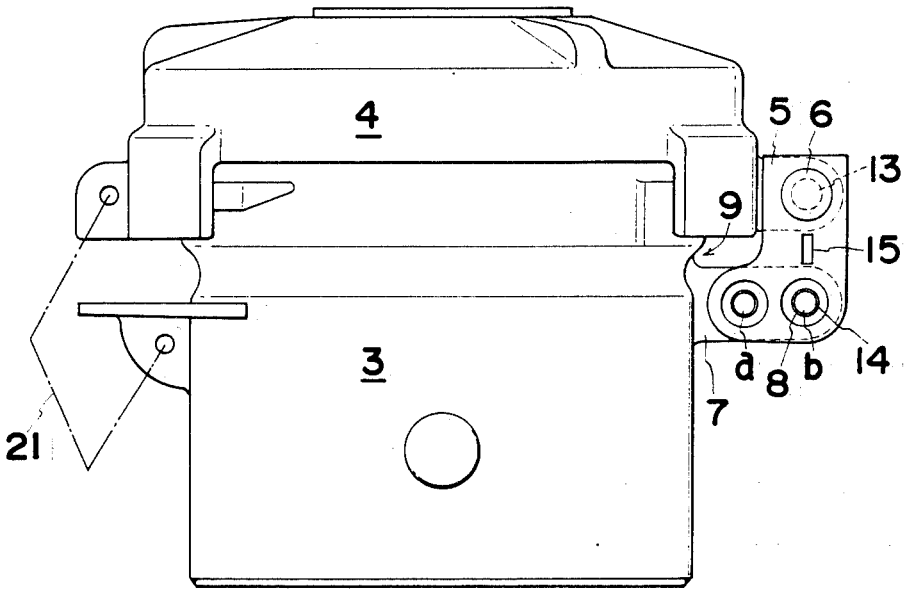
FIG. 4 is a side view of another example of the essential part shown in FIG. 2.
Figure 5:
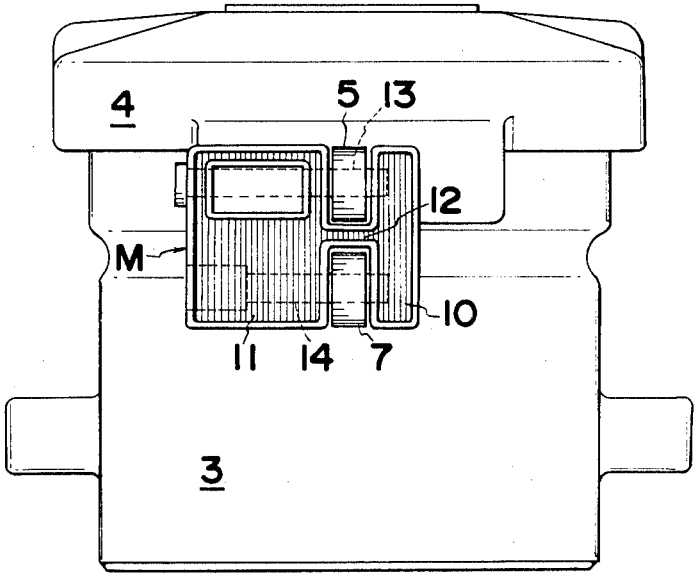
FIG. 5 is a front view of the essential part shown in FIG. 4.
Figure 6:
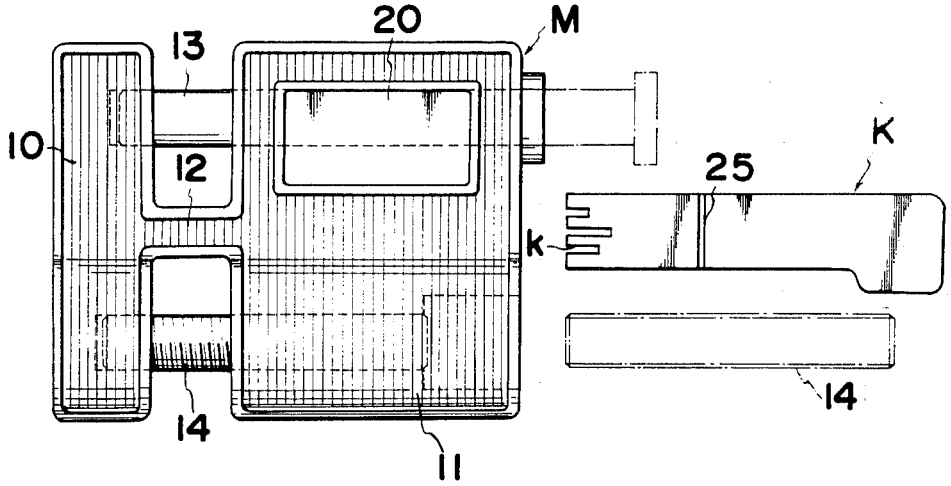
FIG. 6 is a front view of a lock employed in the lock system in accordance with the present invention.
Figure 7:
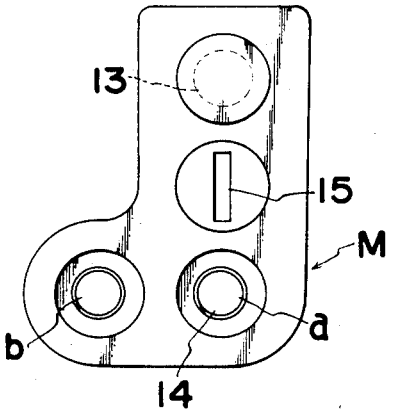
FIG. 7 is a side view of the lock of FIG. 6.

Embodiments of the present invention will be described hereinunder in detail, with reference to the accompanying drawings.

Underground a gasoline stand denoted by reference symbol A, a plurality of underground tanks 1-1, 1-2, 1-3 . . . are buried for the different kinds of oil. A oil filler port projecting from the ground is connected to each underground tank of the gasoline stand A by a pipe 2 buried underground.

Each oil filler port is constituted by a coupling 3, and a cover 4 detachably screwed onto each coupling 3.

More specifically, each coupling 3 is formed as a male member and the cover 4 as a female member which is screwed onto the top of the coupling 3. The upper end of an upper latch member 5 is provided on the peripheral wall of the cover 4. The lower part of the upper latch member 5 is provided with a lock rod-receiving hole 6. The coupling 3 has a lower latch member 7 projecting from the lower part of its peripheral wall, and the free end of the lower latch member 7 is provided with a retainer hole 8. A predetermined gap 9 is provided between the upper latch member 5 and the lower latch member 7. The upper and lower latch members 5, 7 provided on each of the couplings 3 of the underground tanks 1-1, 1-2, 1-3 . . . are provided with locks M-1, M-2, M-3 . . . , respectively, as described below.

Each lock M is constituted by a keeper 10 on its left side and a lock body 11 on its right side, which are connected by a connecting member 12. Above the connecting member 12, a lock rod 13 extends movably between the lock body 11 and the keeper 10. The lock rod 13 can be retracted to slide into the lock body 11 by means of a lock mechanism (not shown) within the lock body 11.

Below the connecting member 12, a retainer rod 14 extends between the lock body 11 and the keeper 10.

The lock M is mounted as shown in FIGS. 2 to 5. With the retainer rod 14 inserted into the retainer hole 8 in the lower latch member 7 of the coupling 3, and the connecting member 12 positioned between the upper and lower latch members 5, 7, the lock rod 13 is slid into the lock rod-receiving hole 6 in the upper latch member 5, to bring the upper and lower latch members 5, 7 into an integrally-coupled locked state. To unlock the lock M, a key K is inserted into a keyhole 15 provided in a side surface of the lock body 11, to make the lock rod 13 retract to release the locking engagement between the lock M and the upper latch member 5. Then the lock M is pivoted downward about the retainer rod 14, and the cover 4 is unscrewed to remove it from the coupling 3, thereby opening the oil filler port.

Figure 9:
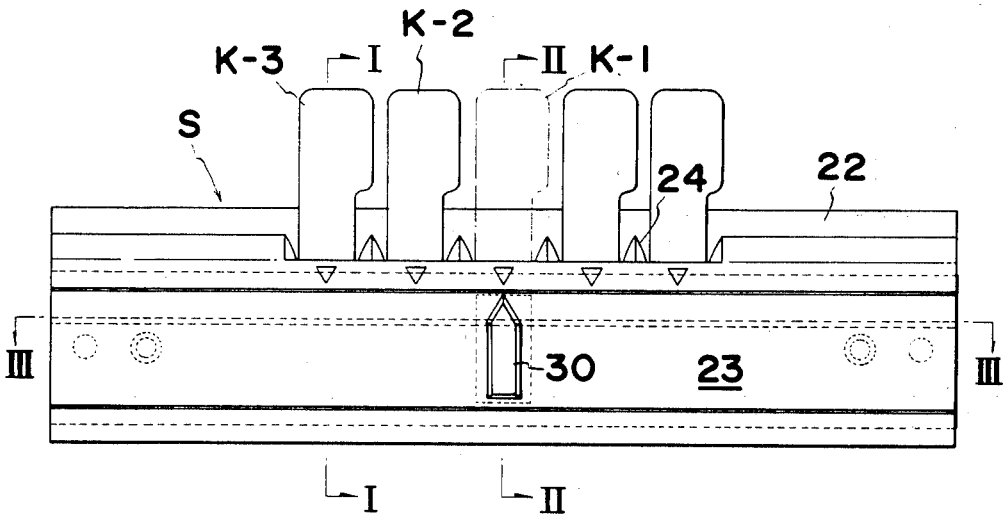
FIG. 9 is a front view of a key-storing device employed in the lock system in accordance with the present invention.
Figure 11:
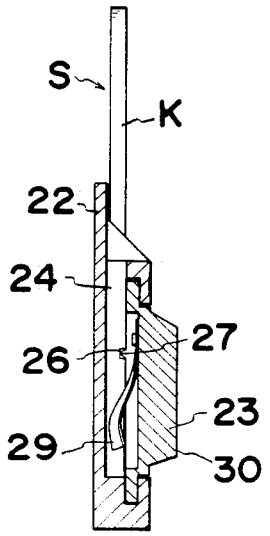
FIG. 11 is a section taken along the line II—II of FIG. 9.
Figure 10:
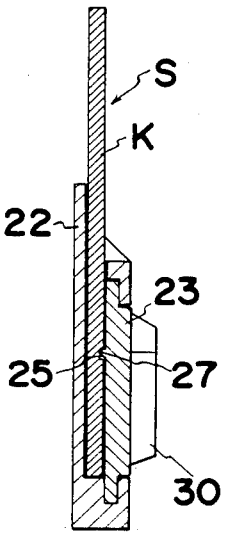
FIG. 10 is a section taken along the line I—I of FIG. 9.
Figure 12:
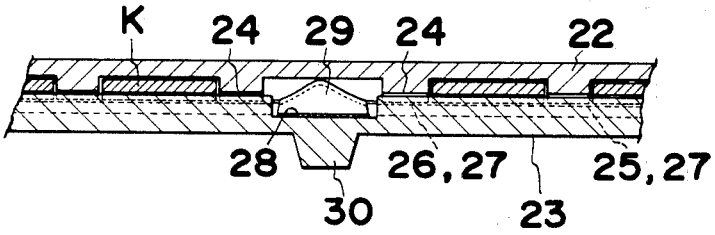
FIG. 12 is a section taken along line III—III of FIG. 9.
Figure 13:
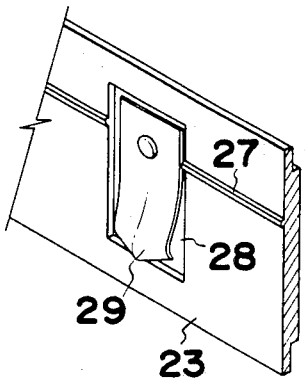
FIG. 13 is a perspective view of part of the rear surface of an indicator plate of the keystoring device.
Figure 14:
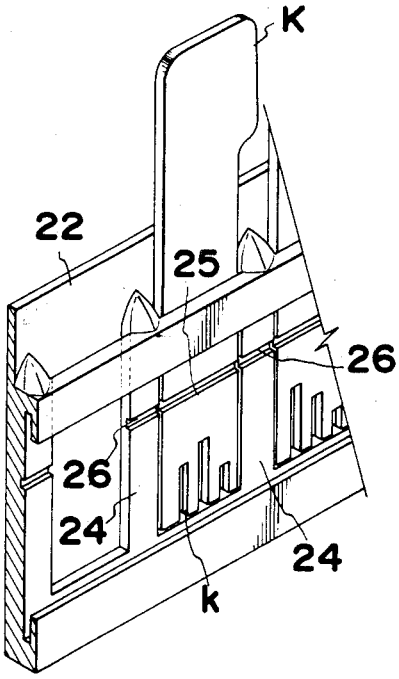
FIG. 14 is a perspective view of part of a key-holding frame of the key-storing device.

In this way, the locks M-1, M-2, M-3 . . . are attached to the oil filler ports of the underground tanks 1-1, 1-2, 1-3 . . . , each containing a different kind of oil, and different keys K-1, K-2, K-3 . . . , which can unlock the locks M-1, M-2, M-3 . . . , respectively, are separately stored in a keystoring device S (FIG. 9).

Each of tank chambers 16-1, 16-2, 16-3 . . . of a tank truck B which pours oil into the underground tanks of the gasoline stand A is provided on an upper part with a hatch handle 17 and a base valve handle 18. The hatch handles 17 are used for opening and closing each of the hatches when the tank chambers of the tank truck B are filled with oil at the oil tank facility. The base valve handles 18 are used for opening and closing each of the base valves when the oil is removed from the tank chambers 16. A lock cord 19 extends between each base valve handle 18 and the corresponding hatch handle 17. One end loop 19-1 of the cord 19 engages with a lock rod N-13 of a lock N of the same construction as that of the lock M, while the other end loop 19-2 engages with a retainer rod N-14 of the lock N. A lock cord 19 is attached to the hatch handle 17 and the base valve handle 18 on each tank chamber. In addition, each of locks N-1, N-2, N-3 . . . attached to the lock cords 19 have the same construction as that of the locks M-1, M-2, M-3 . . . attached to each of the oil filler ports of the gasoline stand A, and therefore can only be unlocked with the keys K-1, K-2, K-3 . . . for unlocking the corresponding locks M.

Each of the locks M, N is provided with a column 20 for carrying the name of the kind of oil, such as regular gasoline, high-octane gasoline, light oil, or kerosene.

The retainer rod 14 of each lock M can be placed for retention at either a front or rear position. Two, front and rear, retainer rodretaining holes a, b are provided in the lower parts of both the lock body 11 and the keeper 10, below the connecting member 12. Thus, the holes a, b used by the retainer rod 14 are selected as appropriate according to the shapes of the upper and lower latch members 5, 7 of the cover 4 and the coupling 3, respectively. More specifically, the holes a, b are selected according to the differences in structure between the upper and lower latch members 5, 7 of the coupling shown in FIGS. 2, 3 and that shown in FIGS. 4, 5.

In the drawings, reference numeral 21 denotes a chain connecting the coupling 3 and the cover 4.

The following is a description of the keystoring device S for storing the keys K-1, K-2, K-3 . . .

The key-storing device S, which is installed at the gasoline stand A, is constituted by a keyholding frame 22 and a slidable indicator plate 23. The key-holding frame 22 is provided with partition plate 24 at predetermined spacing for holding the keys. Each key is held between adjacent partition plates so that it can be pulled upward. The upper surfaces of each key and partition plate 24 are flush with each other, and have common lateral grooves 25, 26, respectively, formed therein.

The indicator plate 23 is constructed so that it can slide horizontally along the upper surfaces of the keys held in the key-holding frame 22 and the partition plates 24. The indicator plate 23 has on its reverse surface an elongated protrusion 27 which fits into the lateral grooves 25, 26. An intermediate portion of the elongated protrusion 27 is cut out for a distance substantially equal to the width of a key. A recess 28 is formed in the part of the reverse surface of the indicator plate 23 corresponding to the cut portion. The recess 28 is provided with a leaf spring 29 of which the free end projects partially outward. The part of the surface of the indicator plate 23 opposite to the recess 28 is provided with an indicator arrow 30.

Each key K has an elongated tabular shape, and one end thereof is provided with a combination of notches K which fits the corresponding pair of locks.

With the indicator plate 23 mounted on the keyholding frame 22, the elongated protrusion 27 can slide along the lateral grooves 25, 26, and the projecting part of the leaf spring 29 is pushed back into the recess 28 by the upper surface of each key and each partition plate 24, so will not prevent the indicator plate 23 sliding. The elongated protrusion 27 makes it impossible to pull out any key.

However, if the indicator arrow 30 is aligned with the position of one of the keys, e.g. the key K-1 for regular gasoline, it becomes possible to pull out the key K-1, since the recess 28 is located at the key K-1 and the elongated protrusion 27 is cut out at the recess 28. After the key K-1 has been removed, the projecting end of the leaf spring 29 is received between the adjacent partition plates 24, so that the partition plates 24 ensure that the indicator plate 23 cannot slide. When the key K-1 is returned to its former position, however, the indicator plate 23 is able to slide. In other words, the arrangement is such that two or more keys can never be drawn out at a time.

The present invention arranged as above is used as described hereinunder. The base valve handles 18 and the hatch handles 17 of the tank chambers 16-1, 16-2, 16-3 . . . of the tank truck B are initially locked by the locks N-1, N-2, N-3 . . . , respectively, and the couplings 3 of the oil filler ports of the underground tanks 1-1, 1-2, 1-3 . . . are locked by the locks M-1, M-2, M-3 . . . , respectively. The keys K-1, K-2, K-3 . . . for unlocking the locks M, N for the corresponding kinds of oil are stored in the key-storing device S.

The tank truck B is driven to the gasoline stand A. When oil is supplied to the underground tanks 1-1, 1-2, 1-3 . . . from the tank chambers 16-1, 16-2, 16-3 . . . of the tank truck B, respectively, first the indicator plate of the key-storing device S is slid to set the indicator arrow at the kind of oil being supplied, e.g., the key K-1 for regular gasoline, and the key K-1 is pulled out. After the key K-1 has been removed, the indicator plate 23 is automatically prevented from sliding, making it impossible to pull out any other keys K-2, K-3 . . . . Using the removed key K-1 for regular gasoline, the lock M-1 on the oil filler port of the underground tank 1-1 for regular gasoline is unlocked so that the cover 4 of the coupling 3 can be opened, and a hose c of the tank truck B is connected to the coupling 3. Then, with the same key K-1, the lock N-1 locking the base valve handle 18 and the hatch handle 17 of the tank chamber 16-1 is unlocked to allow regular gasoline to flow through the hose c from the tank chamber 16-1 holding regular gasoline, thereby supplying regular gasoline to the underground tank 1-1 from the oil filler port. When the supply of oil is completed, the locks M-1, N-1 are locked with the key K-1, which is then placed in the key-storing device S. The indicator plate 23 is then slid to the position of the key K-2 for another kind of oil so that the key K-2 for that kind of oil can be removed, and that key is used to supply the other kind of oil to the underground tank 1-2, using the same procedure as that for the key K-1.

It is to be noted that in the operation of supplying oil to the tank truck B at the oil tank facility, it is also possible to employ the combination of locks N for the hatch handles 17 and the correspnding lock of an oil tank of the facility. A key-storing device S can also be installed at the oil tank facility in addition to the gasoline line stand A.

According to the present invention, no base valve of the tank truck and no coupling of an oil filler port at the gasoline stand can be opened, unless a key for the same kind of oil is used. Therefore, it is possible to reliably pour the same kind of oil as that held in an underground tank. Further, since the keys are stored in a key-storing device at the gasoline stand, and only one key can be removed at a time, there is no possibility that another key can be used when one key is already in use. Accordingly, the possibility has been eliminated that another lock could be unlocked to supply a different kind of oil to an underground tank from another tank chamber. Therefore, when a key is manipulated, it is possible to confirm that there will be no mistake in the oil supply, without relying on mere visual acuity. Thus, the present invention makes it possible to prevent the undesirable mixing of different kinds of oil. Moreover, it is also possible to prevent the theft of oil during transportation by tank truck.

I claim:

1. A lock system for preventing the mixing of different kinds of oil at a gasoline station, said lock system comprising: locks for different kinds of oils provided on each oil filler port of underground tanks of the gasoline station and each of the tank valves of a tank truck, wherein the lock on each of the filler ports of underground tanks can be unlocked by only a selected key which can also unlock only the corresponding tank valve of the tank truck; and keys separately provided for unlocking said locks for said different kinds of oil, said keys being stored in a key-storing device installed at the gasoline station, said key-storing device comprising means for permitting removal of only one key for one kind of oil at a time, so that only the filler port having a lock corresponding to the key, and only the tank valve having a lock corresponding to the key can be opened at a time.

2. A system for preventing filling any tank at a facility having a plurality of tanks containing different liquids with an improper liquid from a vehicle carrying a plurality of different liquids in separate compartments, at least two of the different liquids in the compartments of the vehicle being the same respectively as the different liquids in at least two of the tanks of the facility, said system comprising, a separate valve for each compartment of the vehicle, each valve being movable to an open position to permit flow of a selected liquid from a selected compartment of the vehicle, each tank of the facility having a separate filler port for filling a liquid into its tank, a lock on each filler port, a lock on each valve of the vehicle, a lock for the filler port of a tank at the facility being unlockable only by the same key which can unlock a valve of the vehicle for the compartment containing the same liquid, a plurality of keys, one for each filler port for different liquids, and one for each valve of the vehicle for different liquids, and key storing means at said facility for storing said keys, said key storing means comprising means to permit removing only one key at a time from the key storing means, so that only one key for one kind of liquid can be removed at a time, whereby, only the lock of a filler port and the lock of a valve for a corresponding liquid can be unlocked at the same time, so that inadvertently mixing improper liquids is avoided.

* * * * *